US006460391B1

(12) United States Patent
Liefer et al.

(10) Patent No.: US 6,460,391 B1
(45) Date of Patent: Oct. 8, 2002

(54) CLAMPING ASSEMBLY FOR SHEET METAL LEVELING MACHINE

(75) Inventors: Kalin Liefer; Elroy Schoenbeck, both of Randolph County, IL (US)

(73) Assignee: Red Bud Industries, Inc., Red Bud, IL (US)

( * ) Notice: Subject to any disclaimer, the term of this patent is extended or adjusted under 35 U.S.C. 154(b) by 0 days.

(21) Appl. No.: 09/778,408

(22) Filed: Feb. 7, 2001

(51) Int. Cl.[7] ..... B21D 25/04
(52) U.S. Cl. ..... 72/302
(58) Field of Search ..... 72/302, 301, 295

(56) References Cited

U.S. PATENT DOCUMENTS

| | | | | |
|---|---|---|---|---|
| 3,107,716 A | * | 10/1963 | Wehmeyer | 269/256 |
| 3,595,057 A | * | 7/1971 | Mackenzie | 72/302 |
| 4,706,486 A | * | 11/1987 | Kan | 269/152 |
| 4,751,838 A | | 6/1988 | Voges | 72/302 |
| 4,982,593 A | | 1/1991 | Holloway | 72/302 |
| 5,491,999 A | | 2/1996 | Holloway | 72/302 |
| 6,018,970 A | * | 2/2000 | Ford et al. | 72/21.5 |
| 6,272,897 B1 | * | 8/2001 | Ciranna | 72/296 |

FOREIGN PATENT DOCUMENTS

| | | | |
|---|---|---|---|
| GB | 739291 | * 10/1955 | 72/302 |

* cited by examiner

*Primary Examiner*—Daniel C. Crane
(74) *Attorney, Agent, or Firm*—Polster, Lieder, Woodruff & Lucchesi, L.C.

(57) ABSTRACT

A clamping assembly for a machine that levels sheet metal by stretching the metal beyond its elastic limit includes two jaws which have generally planar gripping surfaces. When the jaws are forced together, the gripping surfaces on them bear against the sheet metal with enough frictional contact to enable a stretching force to be applied to the sheet metal. One of the jaws includes a bearing block and a gripping pad located along the bearing block, with the gripping surface for that jaw being on the pad. A shim that is narrower than the pad lies between the pad and the bearing block. When the pad is forced against the sheet metal, the shim behind that pad causes the pad to assume a slight contour that imparts convexity to its gripping surface. This concentrates the gripping force at the centers of the gripping surfaces on the two jaws, so that perceptible indentations do not develop in the strip at the side edges of the gripping surfaces.

24 Claims, 4 Drawing Sheets

CLAMPING ASSEMBLY FOR SHEET METAL LEVELING MACHINE

CROSS-REFERENCE TO RELATED APPLICATIONS

STATEMENT REGARDING FEDERALLY SPONSORED RESEARCH OR DEVELOPMENT

Not Applicable.

BACKGROUND OF THE INVENTION

This invention relates in general to leveling sheet metal by stretching it and more particularly to a clamping assembly and process for gripping the sheet metal without leaving perceptible indentations or otherwise marring it.

Steel sheet finds widespread use in manufactured products of many varieties. In some, such as housings, cabinets and covers of one type or another, relatively large expanses of sheet metal are exposed and are highly visible. But steel sheet as it is sold by steel mills contains imperfections, such as warpage and wavy regions, that render it unsuitable for such products. The steel needs further processing, and that processing takes the form of leveling, that is, stretching the metal sheet slightly beyond its yield point to give it a more uniform surface appearance.

One type of leveling machine has rolls arranged in two sets, one set beyond the other. The strip of steel sheet passes through the two sets of rolls, both of which are arranged to grip it firmly. The downstream set rotates faster than the upstream set, and the steel sheet undergoes a measure of stretching in between the two sets of rolls. But these machines subject the strip to substantial distortions as the strip passes over the rolls, and further require enormous power.

Another type of leveling machine grips the sheet with two sets of jaws which are spaced apart. Once the jaws of the two sets clamp down on the sheet, the two sets are forced apart, thereby stretching and leveling the sheet metal. The jaws enable this type of machine to grip the sheet metal along reasonably large surface areas, and slippage for all intents-and-purposes is eliminated.

However, care must be exercised to insure that the jaws, in the process of eliminating warpage, do not themselves create surface markings or other imperfections. In this regard, the jaws used on leveling machines clamp down with considerable force on the sheet metal and may leave indentations at the sides of the jaws. The problem is particularly acute with stainless steel sheet, because it is more reflective than low carbon steel and less likely to be painted. As a consequence, surface markings and other imperfections in stainless steel sheet are more perceptible.

BRIEF SUMMARY OF THE INVENTION

The present invention resides in two opposing jaws which have the capacity to clamp down on and grip sheet metal in a leveling machine without marring the surface of the sheet metal. The jaws concentrate the clamping force away from the side edges of the area that is gripped, so that the jaws are less likely to leave perceptible marks on the sheet metal. To this end, a traditional flat gripping pad is installed in one of a pair of jaws, and it is backed by a shim which is narrower than the surface which backs it, thus enabling the pad to flex and assume a slightly bowed configuration under the force applied to it, and in this configuration the actual gripping surface on the pad is slightly convex. The invention also resides the process of installing a shim behind one of the pads to concentrate the gripping force along the center of the pad. The invention also consists in the parts and in the arrangements and combinations of parts hereinafter described and claimed.

BRIEF DESCRIPTION OF THE SEVERAL VIEWS OF THE DRAWINGS

In the accompanying drawings which form part of the specification and wherein like numerals and letters refer to like parts wherever they occur.

Corresponding reference numerals will be used throughout the several figures of the drawings.

DETAILED DESCRIPTION OF THE INVENTION

Figure 1:
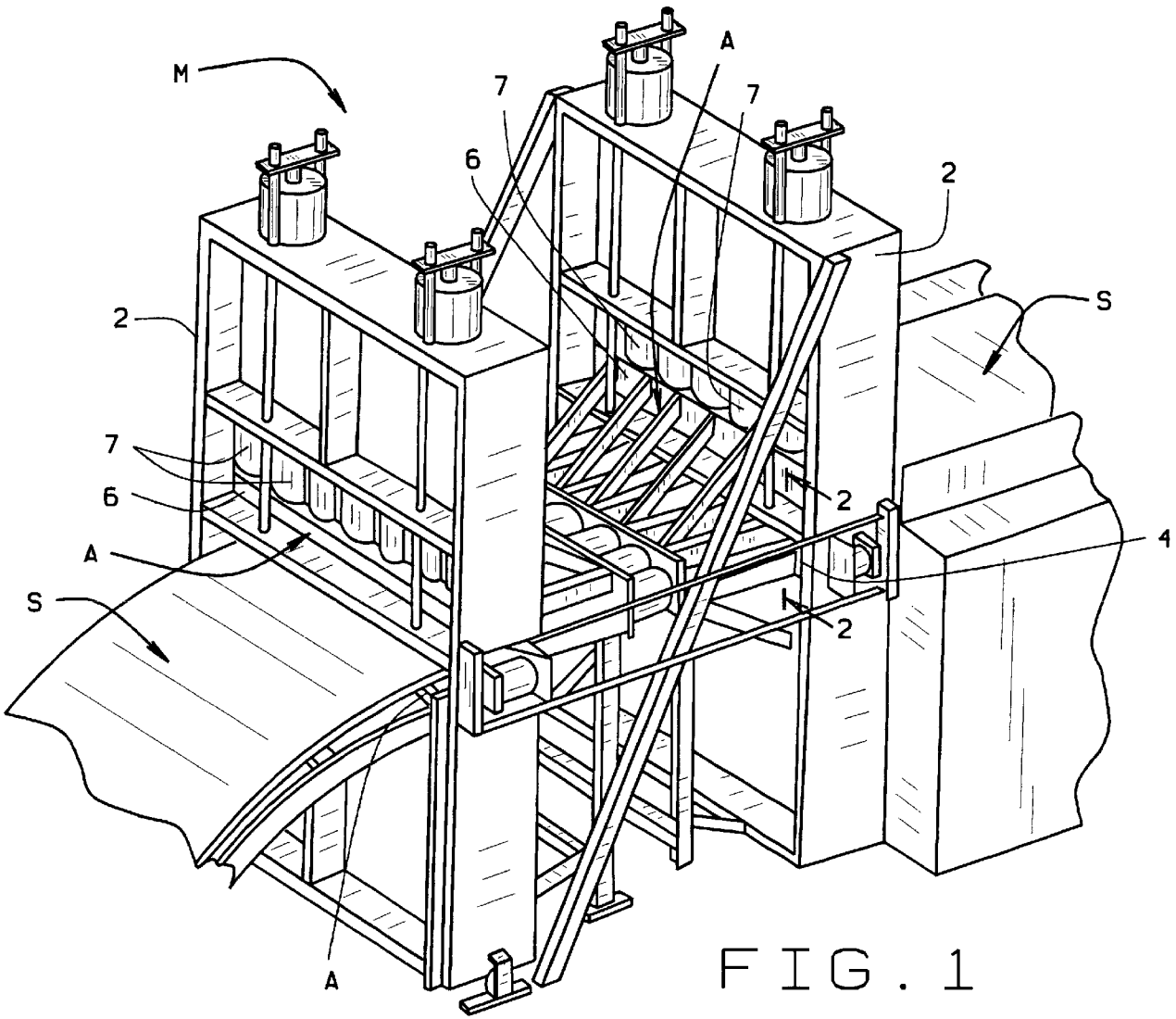
FIG. 1 is a perspective view of a leveling machine fitted with clamping assemblies constructed in accordance with and embodying the present invention.

A machine M for leveling sheet metal has two clamping assemblies A through which a strip S of sheet metal passes (FIG. 1). The clamping assemblies A clamp down upon the strip S with considerable force across the entire width of the strip S, and frictionally grip the strip S. While the strip S is so gripped, the two clamping assemblies A are forced apart with enough force to exceed the yield strength of the region of the strip S between them, and this causes that region of the strip S to stretch beyond its elastic limit. The stretching removes distortions, such as warpage, from the strip. U.S. Pat. No. 4,751,838, entitled Machine and Process for Leveling Sheet Metal Strip, discloses a machine of the type on which the clamping assemblies A may be used, and is incorporated in this discussion by reference.

Figure 2:
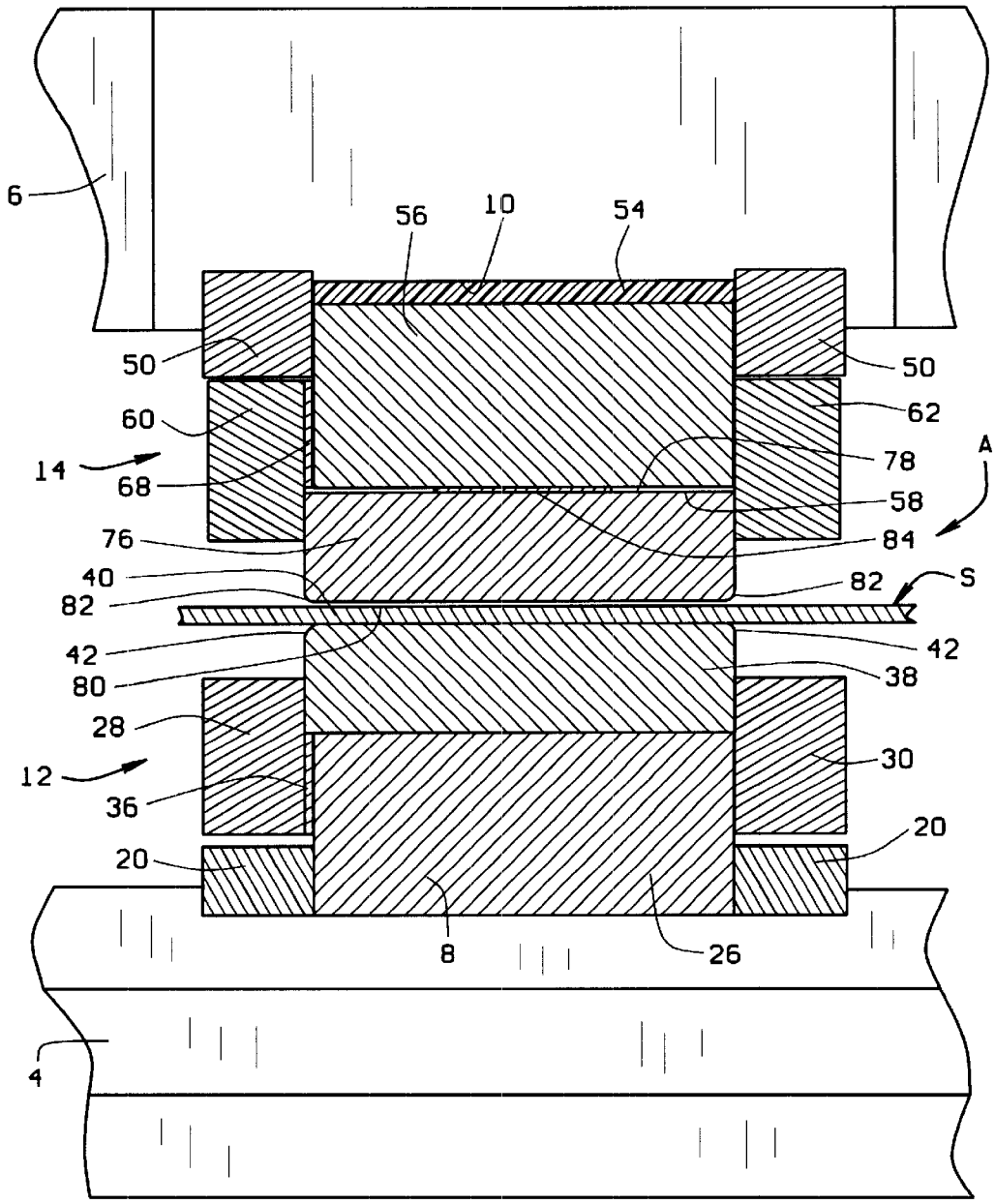
FIG. 2 is a sectional view taken along line 2—2 of FIG. 1 and showing one clamping assembly with its jaws in the open position.

Each clamping assembly A lies within a stretcher frame 2 (FIG. 1) that includes a rigid lower beam 4 and an equally rigid upper beam 6. The lower beam 4 forms part of the frame 2 and as such is fixed in position with respect to the frame 2. The upper beam 6, on the other hand, is carried by the frame 2 such that it can move toward and away from the lower beam 4. Indeed, the frame 2 supports several hydraulic cylinders 7 which act upon the upper beam 6 to urge it downwardly toward the lower beam 4 with considerable force. The beams 4 and 6 lie parallel to each other and transverse to the strip S of sheet metal which passes between them. The lower beam 4 has a recess 8 (FIG. 2) of rectangular cross-section which extends longitudinally along it. The upper beam 6 has a somewhat deeper recess 10 which extends longitudinally in it and opens toward the recess 8 in the lower beam 4. Hence, the recesses 8 and 10 extend transversely with respect to the strip S. Each clamping assembly A includes a lower jaw 12 which fits to the recess 8 of the lower beam 4 and projects upwardly from it and an upper jaw 14 which fits into the recess 10 of the upper beam 6 and projects downwardly from it. Indeed, the upper jaw 14 aligns with the lower jaw 12. Normally, the jaws 12 and 14 are spaced far enough apart to enable the strip S to pass loosely between them, but when the cylinders 7 behind the upper beam 6 and jaw 14 are energized, the upper jaw 14 moves toward the lower jaw 12 and clamps the strip S tightly between the two jaws 12 and 14.

Figure 3:
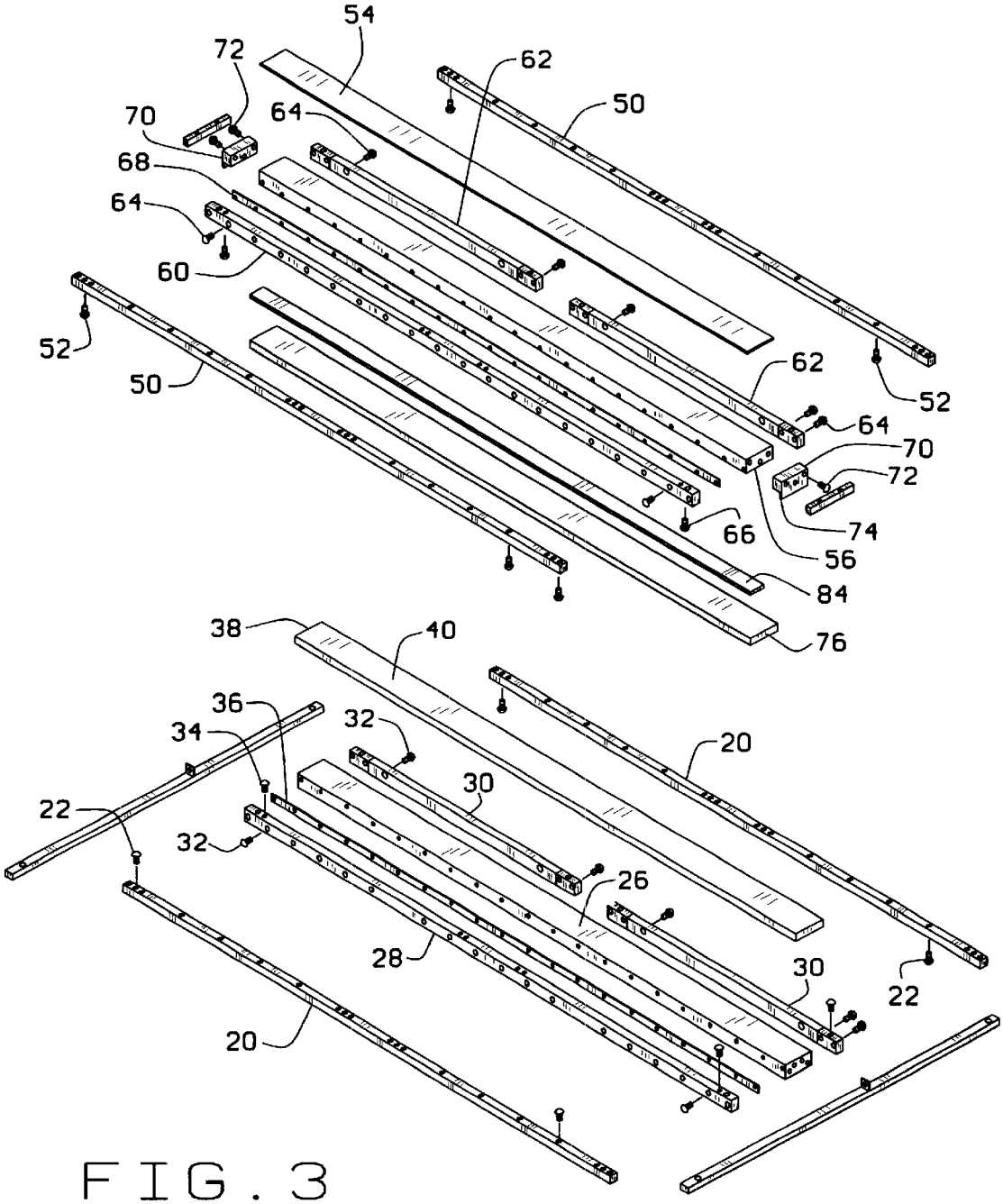
FIG. 3 is an exploded perspective view of the clamping assembly.
Figure 4:
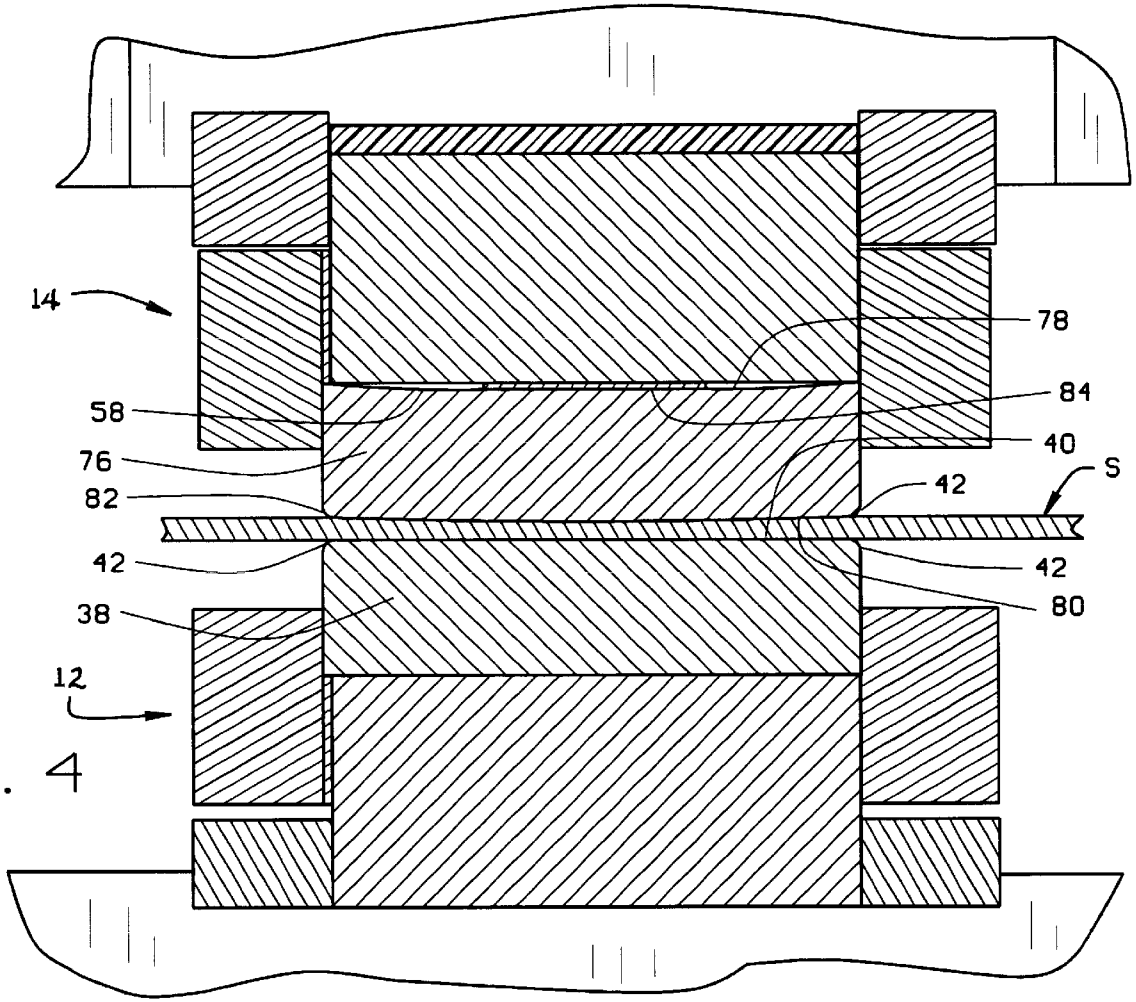
FIG. 4 is a sectional view similar to FIG. 2, but showing the clamping assembly with its jaws closed and clamped against a sheet metal, the curvature of the gripping pad for the upper jaw being exaggerated to better illustrate the invention.

The lower jaw 12 includes (FIGS. 2 and 3) two edge liners 20 which lie along the sides of the groove 8 in the lower beam 4 for the full length of the groove 8, and are fastened to lower beam 4 with machine screws 22 that pass vertically through the liners 20 and thread into the beam 4. The edge liners 20 project out of the recess 8 and together with the bottom surface of the recess 8 form a pocket which receives a bearing block 26 that fits snugly between the liners 20 and, like the liners 20, extends the full length of the recess 8. Both the bearing block 26 and the liners 20 rest against the bottom of the recess 8, but the bearing block 26 is considerably higher than the liners 20 and thus projects upwardly beyond them. Along the sides of the bearing block 26 are inner and outer side bars 28 and 30 which are attached firmly to the bearing block 26 with machine screws 32 that pass laterally through the bars 28 and 30 and thread into the block 26. The bars 28 and 30 lie over the edge liners 20, but are separated slightly from the liners 20. Nevertheless, the side bars 28 and 30 are attached firmly to the liners 20 with more machine screws 34 which extend vertically through them and thread into the liners 20. The inner side bar 28, which is closest to the region of the strip S that is to be leveled, extends the full length of the bearing block 26 and is separated from the block 26 by a thin strip 36 through which the screws 32 likewise pass, but the strip 36 does not rise above the block 26. The outer side bar 30 exists in two segments which are set end-to-end.

Finally, the lower jaw 12 has a gripping pad 38 (FIGS. 2 and 3) which rests on the bearing block 26 between the side bars 28 and 30. Indeed, the gripping pad 38 fits snugly between the side bars 28 and 30, so that its side face abuts firmly against the side bars 28 and 30. The friction at these surfaces holds the gripping pad 38 in place. The gripping pad 38 is at least as long as the strip S of the sheet metal is wide, so that it will extend completely across the strip S. It has a planar gripping surface 40 that is presented upwardly, between curved edges 42 which merge into the side surfaces of the pad 38, that is into the surfaces which are against the side bars 28 and 30 The curved edges 42 have radii ranging between 1/32 and 1/16 inches.

The upper jaw 14 includes (FIGS. 2 and 3) two edge liners 50 which fit into the recess 10 in the upper beam 6 where they line the edges of the recess 10. The liners 50, which are secured firmly to the upper beam 6 with machine screws 52 that pass vertically through the liners 50 and thread into the upper beam 6, project out of the recess 10 and beyond the lower surface of the beam 6. They form a pocket that opens downwardly toward the lower jaw 12.

That pocket contains a relatively soft pad 54 which fully occupies the area between the two edge liners 50, yet is set well above the lower surfaces of the liners 50 and even above the lower surface of the upper beam 6. Preferably the soft pad 54 is formed from polyurethane that is about 1/4 inches thick. The pocket between the edge liners 50 also contains a bearing block 56 which, like the soft pad 54, completely occupies the area between the two edge liners 50. Moreover, the bearing block 56 is considerably thicker than the pocket is deep and thus projects downwardly below the lower surface of the edge liners 50. The upper surface of the bearing block 56 abuts the soft pad 54. The bearing block 56 has a downwardly presented backing surface 58 which is planar.

The bearing block 56 of the upper jaw 14 has inner and outer side bars 60 and 62 attached to it with machine screws 64 that pass laterally through the bars 60 and 62 and thread into the block 56. The inner side bar 60 lies along the region of the strip S that requires leveling and extends the full length of the block 56. The outer side bar 62 is segmented, with its two segments lying end to end. The side bars 60 and 62 underlie the edge liners 50, and are attached to the edge liners 50 with machine screws 66 which pass vertically through the bars 60 and 62 and thread onto the liners 50, but even so a slight space exists between the bars 60 and 62 and the overlying liners 50. Both side bars 60 and 62 project downwardly below the planar lower surface 58 of the bearing block 56. Moreover, the inner bar 60 is separated from the block 56 by a thin strip 68 which lies entirely above the planar surface lower surface 58 on the block 56, even though the screws 64 pass through it.

At its ends the bearing block 56 is fitted with end caps 70 (FIG. 3) which are attached to it with still more machine screws 72. The end caps 70 have lips 74 which project downwardly from it a distance equivalent to the downward projection of the side bars 60 and 62.

The pocket formed by the downwardly projecting side bars 60 and 62 and the lips 74 on the end caps 70 receives an upper gripping pad 76 which fits snugly between the side bars 60 and 62 and is held in place with the friction that exists between its side faces and the side bars 60 and 62. The gripping pad 76 has a planar back face 78 which is presented toward the planar backing surface 58 of the bearing block 56. It also has a planar gripping surface 80 which is presented downwardly toward the gripping surface 40 on the pad 38 of the lower jaw 12. The gripping surface 80 lies between curved side edges 82 having radii ranging between 1/32 and 1/16 inches. The pad 76 is between 15% and 50% as the thick as it is wide.

When the two jaws 12 and 14 are separated and not exerting any force on the strip S, or on each other, a slight gap exist between the planar back face 78 of the gripping pad 76 and the planar backing surface 58 of the bearing block 56. Within this gap lies a shim 84, and indeed, the shim 84 establishes the gap. But the shim 84 does not occupy the entire gap. While it extends the full length of the block 56 and pad 76, it does not extend out to the sides of the back face 78 and to the side bars 60 and 62 along those sides. Instead, its width ranges between 25% and 75% of the width of the pad 76 and is preferably 50% as wide as the pad 76. Moreover, it is centered laterally with respect to the block 56 and pad 76. The shim 84 may be formed from traditional metal shim stock or even an adhesive-backed tape, such as duct tape. Its thickness should be between 0.005 and 0.015 inches and when the pad 76 is 4 inches wide, its thickness is preferably 0.010 inches.

The liners 50, bearing block 56, side bars 60 and 62 and end cap 70 are all formed from low carbon steel.

Preferably, each pad 38 and 76 is formed from high carbon, high chromium tool steel known as D-2. The steel is machined on all of its surfaces and is heat treated to achieve a hardness ranging between RC57 and RC59. To enable the pads 38 and 76 to more effectively grip the strip S, minute particles of tungsten carbide may be applied to them at their gripping surfaces 40 and 80, using a common coating procedure. Preferably, the pads 38 and 76 are identical so that they may be interchanged. Typically, each is 4 inches wide and 1 inch thick.

In the operation of the clamping assembly A, the strip S of sheet metal advances through the jaws 12 and 14 while they are separated, and is brought to rest at the border of a region in the strip S that requires leveling. Thereupon, the cylinders 7 behind the upper beam 6 are energized, and the upper jaw 14 moves downwardly toward the lower jaw 12, clamping the strip S between the gripping pads 38 and 76 of the jaws 12 and 14 with considerable force. The soft pad 54 behind the bearing block 56 in the upper jaw 14 distributes the force generally uniformly along the jaw 14. Actually, the gripping surface 40 of the lower pad 38 bears against the bottom surface of the strip S, whereas the gripping surface 80 of the upper pad 76 bears against the top surface of the strip S. The carbide particles along the gripping surfaces 40 and 80 bite into the metal to enhance the friction between the pads 38 and 76, yet are so fine that they do not mar the surface, at least to the extent that any perceptible marring is evident.

As the gripping pads 38 and 76 close upon the strip S, the upper pad 76 bows slightly about its longitudinal axis inasmuch as the pad 76 is initially backed by the bearing block 56 only along the mid-portion of the pad 76 where the shim 84 exists. But as the force increases the side regions of the back face 78 on the upper pad 76 comes against the planar lower surface 58 on the bearing block 56, thus limiting the extent of bowing, but not eliminating the bowing. The curvature in the pad 76 does not stress the pad 76 beyond the elastic limit of the steel from which the pad 76 is formed, so once the force is removed, the pad 76 reverts to its original shape, and the back face 78 and gripping surface 80 again become planar.

Since the gripping surface 80 on the upper gripping pad 76 assumes an arcuate shape, however slight, in cross-section, the force applied by the jaws 12 and 14 to the sheet metal strip S is concentrated along the longitudinal centers of the gripping surfaces 40 and 80 and diminishes outwardly from the region. Indeed, the force is feathered such that the surfaces 40 and 80 leave no perceptible indentations in the strip S along the curved edges 82 of the upper pad 76 or along the curved edges 42 of the lower pad 38. Nor do any perceptible indentation occur where the longitudinal centers of the gripping surfaces 40 and 80 bear against the strip S., that is to say in the regions where the pressure is greatest. This holds true even with stainless steel sheet metal which tends to reveal slight indentations and imperfections more so than sheet metal of more common low carbon steel.

Of course, after the jaws 12 and 14 of one clamping assembly A clamp down on the strip S and like jaws 12 and 14 of the other clamping assembly do the same, the two frames 2 which carry the clamping assemblies A are forced apart. The friction developed at each clamping assembly A between the pads 38 and 76 for the two jaws 12 and 14 and the strip S is great enough to prevent the strip S from slipping between the pads 38 and 76 of the assembly A. The spreading force stresses the metal of the strip S beyond its yield strength, so the strip S in the region between the two frames 2 undergoes a plastic deformation which has the effect of leveling the strip S.

A single shim 84 behind the pad 76 of the upper jaw 14 produces a sufficient feathering of the force to avoid perceptible indentations in both the upper and lower surfaces of the strip S. However, thinner shims 84 may be installed behind both gripping pads 38 and 76.

The same effect could be achieved by machining a slight curvature into the gripping surface 80 of the pad 76 or the gripping surface 40 of the pad 38 or into both gripping surfaces 40 and 80, but machining to the tolerances required is difficult, time consuming, and expensive.

This invention is intended to cover all changes and modifications of the example of the invention herein chosen for purposes of the disclosure which do not constitute departures from the spirit and scope of the invention

What is claimed is:

1. In a machine for stretching sheet metal beyond its elastic limit to level the sheet metal, said machine having a first jaw provided with a gripping surface, and a second jaw having a gripping surface which is presented toward the gripping surface of the first jaw, one of the jaws being capable of moving toward the other jaw to clamp the sheet metal between the gripping surfaces of the two jaws and exerting enough force on the sheet metal to prevent the sheet metal from slipping between the gripping surfaces of the jaws when a stretching force is applied to the sheet metal at the jaws, the second jaw including a bearing block having a backing surface that is presented toward the gripping face of the first jaw, the second jaw also including a gripping pad having a back face that is presented toward the backing surface of the bearing block, the gripping pad being formed from metal, the gripping surface of the second jaw being on the gripping pad where it is presented away from the back face of the pad and toward the gripping surface of the first jaw, the improvement comprising a shim located between backing surface of the bearing block and the back face of the pad, the shim being narrower than the back face of the pad and set inwardly from the sides of the back face on the pad, so as to cause the pad, at the gripping surface on the pad to assume a slightly convex configuration between the sides of the gripping surface when the jaws are forced together with the gripping surfaces bearing against the sheet metal.

2. The combination according to claim 1 wherein the backing surface on the bearing block is as wide as the back face on the pad.

3. The combination according to claim 1 wherein the backing surface on the bearing block and the back face of the pad are planar when the jaws do not grip the sheet metal.

4. The combination according to claim 3 wherein the gripping,surface on the pad is planar when the jaws do not grip the sheet metal.

5. The combination according to claim 4 wherein the gripping surface of the first jaw is planar.

6. The combination according to claim 5 wherein the shim is between 25% and 75% as wide as the back face of the pad.

7. The combination according to claim 6 wherein the pad is between 15% and 50% as thick as it is wide.

8. The combination according to claim 1 wherein the gripping pad has a hardness of at least RC 57.

9. The combination according to claim 8 wherein the bearing member and griping pad are formed from steel.

10. A jaw for gripping sheet metal with sufficient frictional contact to enable a stretching force to be applied to the sheet metal, said jaw comprising: a bearing block having a planar backing surface; a gripping pad located along the backing surface of the bearing block and being fixed in position with respect to the block, the pad being formed from steel and having a back face that is presented toward the backing surface on the bearing block and a gripping surface that is presented away from the bearing block for establishing frictional contact with sheet metal; and a shim located between the backing surface of the bearing block and the back face of the pad, the shim being narrower than the back face of the pad and being set inwardly from the sides of the back face of the pad, so that the pad, when the bearing block forces it against sheet metal, will assume a slight contour and convexity at its gripping surface.

11. A jaw according to claim 10 wherein the backing surface of the bearing block and the back face of the pad are planar when the bearing block is not exerting a force on the pad.

12. A jaw according to claim 11 wherein the gripping surface of the pad is planar and lies parallel to the back face of the pad when the bearing block is not exerting a force on the pad.

13. A jaw according to claim 10 and further comprising side bars attached to the bearing block and projecting beyond the backing surface of the bearing block to create a pocket at the backing surface; and wherein the pad is located in and projects out of the pocket.

14. A jaw according to claim 10 wherein the gripping pad has a hardness of at least RC 57.

15. A process for rendering a sheet metal leveling machine less likely to mar the sheet metal, said machine having a first jaw provided with a gripping surface and a second jaw having a gripping surface which is presented toward the gripping surface of the first jaw, one of the jaws being capable of moving toward the other jaw to clamp the sheet metal between the gripping surfaces of the two jaws and exerting enough force on the sheet metal to prevent the sheet metal from slipping between the gripping surfaces of the jaws when a stretching force is applied to the sheet metal at the jaws, the second jaw including a bearing block having a backing surface that is presented toward the gripping face of the first jaw, the second jaw also including a metal gripping pad having a back face that is presented toward the backing surface of the bearing block, the gripping surface of the second jaw being on the gripping pad where it is presented away from the back face of the pad and toward the gripping surface of the first jaw, said process comprising: interposing a shim between the back surface of the second pad and the backing surface of the bearing block, with the shim being narrower than the pad is wide and having its margins located inwardly from the sides of the pad.

16. A clamping assembly for frictionally gripping metal sheet metal while a stretching force is applied to the metal sheet, said clamping assembly comprising: an elongated first jaw have a gripping surface; and an elongated second jaw located opposite the first jaw and including a bearing member and a gripping pad, the bearing member having a backing surface that is presented toward the gripping surface of the first jaw, the gripping pad being formed from metal and having a gripping surface that is presented away from the backing surface on the bearing member and toward the gripping surface on the first jaw, the gripping pad also having a back face that is presented toward the backing surface of the bearing member, the back face of the gripping pad, when the pad is initially urged toward the bearing member, being separated from, yet capable of moving toward the bearing member near its sides, but not along its midregion between its sides, so that when the jaws are urged together with considerable force and with metal sheet between the gripping surfaces of the jaws, the sides of the gripping pad for the second jaw will move toward the backing surface on the bearing member and the gripping pad will assume a slightly arcuate configuration with its gripping surface becoming slightly convex, whereby the gripping surfaces of the jaws do not mar the metal sheet.

17. A clamping assembly according to claim 16 wherein the metal gripping pad has a hardness of at least RC 57.

18. A clamping assembly according to claim 16 and further comprising a shim located between the backing surface of the bearing member and the back face of the pad and being set inwardly from the sides of the pad to separate the back face of the pad from the backing surface of the bearing member at the sides of the pad and to prevent the pad from moving toward the backing surface of the bearing member at its midregion when a considerable force is applied to the pad.

19. A clamping assembly according to claim 16 wherein the gripping surface of the pad is planar when no force is exerted on the pad.

20. A clamping assembly according to claim 18 wherein the width of the shim ranges between 25% and 75% of the width of the pad.

21. A clamping assembly according to claim 18 wherein the bearing member and the pad are substantially the same width.

22. A clamping assembly according to claim 18 wherein the backing surface of the bearing member is planar.

23. A clamping assembly according to claim 22 wherein the back face and the gripping surface of the pad, when no force is exerted by or on the second jaw, are planar.

24. A clamping assembly according to claim 23 wherein the gripping surface of the first jaw is planar.

* * * * *